United States Patent [19]

Graham

[11] Patent Number: 4,632,181

[45] Date of Patent: Dec. 30, 1986

[54] CERAMIC HEAT EXCHANGER

[76] Inventor: Robert G. Graham, 2433 N. Nile Mile Rd., Sanford, Mich. 48657

[21] Appl. No.: 471,912

[22] Filed: Mar. 3, 1983

[51] Int. Cl.[4] ..... F28F 9/02

[52] U.S. Cl. ..... 165/158; 165/176

[58] Field of Search ..... 165/158, 173, 174, 175, 165/176, 178

[56] References Cited

U.S. PATENT DOCUMENTS

| | | | |
|---|---|---|---|
| 1,429,149 | 4/1922 | Lawrence | 165/174 |
| 1,974,402 | 9/1934 | Templeton | 165/175 X |
| 3,019,000 | 1/1962 | Bork | 165/72 X |
| 3,675,710 | 7/1972 | Ristow | 165/176 X |
| 3,923,314 | 12/1975 | Lawler et al. | 165/173 X |
| 4,018,209 | 4/1977 | Bonvicini | 165/176 X |
| 4,106,556 | 8/1978 | Heyn et al. | 165/81 |
| 4,122,894 | 10/1978 | Laws et al. | 165/DIG. 8 X |
| 4,449,575 | 5/1984 | Laws et al. | 165/178 X |

FOREIGN PATENT DOCUMENTS

| | | | |
|---|---|---|---|
| 191175 | 1/1923 | United Kingdom | 165/158 |
| 2015146 | 9/1979 | United Kingdom | 165/158 |

*Primary Examiner*—William R. Cline
*Assistant Examiner*—Peggy A. Neils
*Attorney, Agent, or Firm*—Krass & Young

[57] ABSTRACT

An all ceramic heat exchanger for heating ambient air from hot waste fumes. In the preferred embodiment, the inlet and outlet tube walls for the ambient air are formed with removable inserts having bell-shaped openings formed therein. Central tube walls include an internal passageway formed therein and serve the dual purpose of supporting the matrix of transversely extending tubes and directing the flow of ambient air to other zones of the heat exchanger.

2 Claims, 8 Drawing Figures

CERAMIC HEAT EXCHANGER

DESCRIPTION

TECHNICAL FIELD

This invention relates to heat exchangers and, more particularly, to heat exchangers utilizing ceramic components.

BACKGROUND ART

Heat exchangers are normally used to extract thermal energy from a heated fluid and may be employed in a wide variety of diverse applications. One such application includes the heating of ambient air by hot waste fumes from an industrial furnace.

In general, conventional heat exchangers utilize a matrix of tubes supported on each end by what is known in the art as a tube sheet. Ambient air flows through these tubes which are disposed in a cross flow of the hot waste fumes. The ambient air in the tubes is heated by the fumes, with the heated air being used for such things as preheating process combustion air or for a wide variety of other purposes.

The most conventional type of heat exchanger employs metal tubes which are welded at their ends to a supporting metal tube sheet. Unfortunately, these metal heat exchangers are subject to deterioration especially when the hot waste fumes are at elevated temperatures and contain chemically corrosive or abrasive particles.

Heat exchangers employing ceramic components have been used in the past in these types of adverse environments. One known heat exchangers employs a sponge or matrix made of ceramic material. Unfortunately, the particulates in the waste fumes have a tendency to plug the matrix after a period of time thereby decreasing its efficiency and, in some instances, creating a fire hazard. Another known system employs metallic springs pushing against one end of the ceramic tube in an effort to provide sealing engagement between the tube and the supporting tube sheet. Unfortunately, systems employing metal components to seal ceramics are subject to leakage problems since metal has a different rate of expansion then ceramic. In addition, the metallic components are still subject to deterioration under the above mentioned adverse conditions in which these types of heat exchangers may be used.

Most of the known heat exchanger designs employ straight sided tubes which empty into plenums formed between the supporting tube sheets and the inner wall of the external housing or casing. The plenums are designed to carry the ambient air to other zones in the internal heat exchanger construction employing another set of tubes for passing the air back through the central chamber through which the heated waste fumes flow. The flow of the ambient air between the plenums and tubes creates a pressure loss within the system. These pressure losses must be overcome by an increase in the horsepower of the fans for moving the ambient air in order to maintain a given velocity of the ambient air flow. These pressure losses also make it difficult to maintain an air tight seal in the ambient air flow subsystem. The resultant leakage which may occur not only decreases the flow of the ambient air but also may allow the fumes to contaminate the ambient air. This mixture is especially undesirable when the waste fumes contain chemically corrosive, abrasive or toxic particles.

SUMMARY OF THE INVENTION

The present invention as set forth in the following specification has several features which may be used alone or in combination. The heat exchanger unit, as a whole, employs an all ceramic construction thereby providing excellent wear characteristics even in adverse environments. One feature of this invention includes the provision of inlet and outlet tube wall units having rounded entries and exits forming bell-shaped openings in their outer faces. The bell openings minimize the pressure drop of the fluid thereby reducing leakage and the amount of energy required to circulate the fluid. In the preferred embodiment, an annular resilient gasket between the inner portion of the bell and the end of the tube is used to provide sealing engagement at the tube-wall interface.

According to one aspect of this invention, the bell openings may be formed in inserts which are removably attached to the wall. When the inserts are removed, easy access may be obtained to the tubes for cleaning or replacement purposes.

In multi-pass heat exchanger designs, a specially constructed central tube wall construction is employed to carry the fluid to other zones. These wall sections include internally formed passageways therein. Thus, the wall units serve the dual purpose of supporting the tubes and providing return air to the other zones in a manner which reduces leakage and horsepower requirements.

BRIEF DESCRIPTION OF THE DRAWINGS

The various advantages of the present invention will become apparent to one skilled in the art upon reading the following specification and by reference to the drawings in which.

DESCRIPTION OF THE PREFERRED EMBODIMENT

Figure 1:
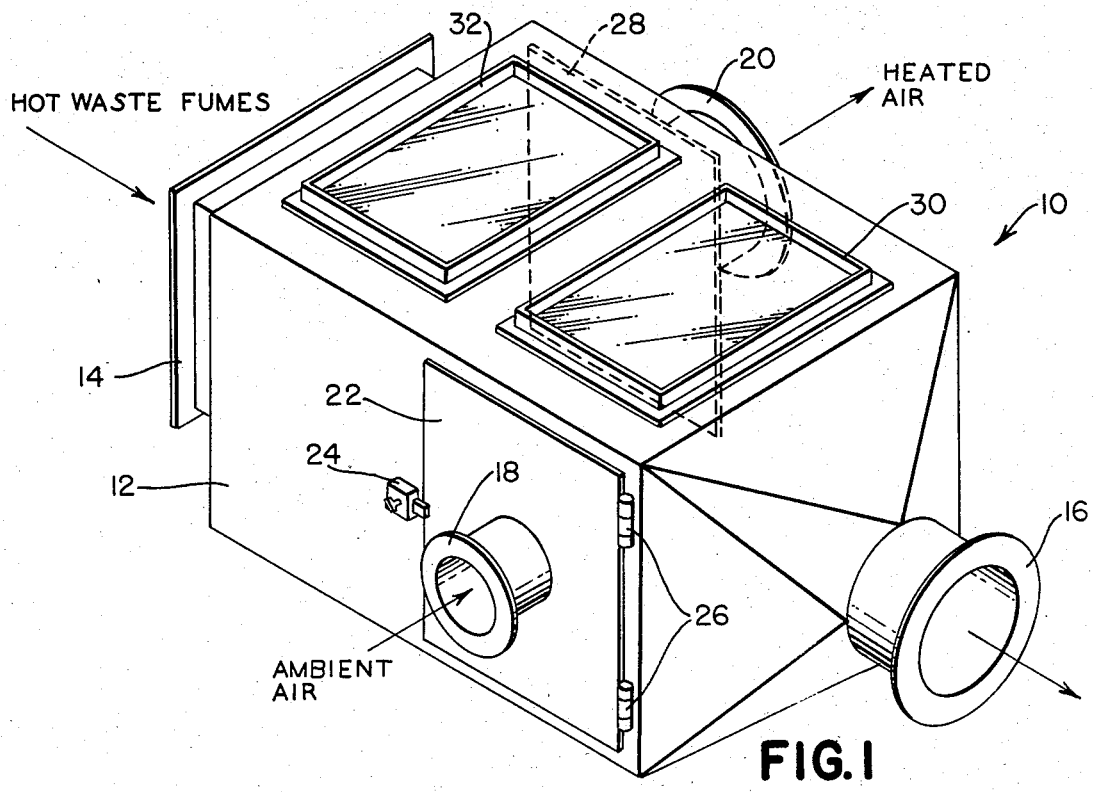
FIG. 1 is a perspective view of an external housing construction which may be utilized in connection with the internal ceramic heat exchanger system of the present invention.

FIG. 1 illustrates the external construction of a heat exchanger 10 made in accordance with the preferred embodiment of this invention. Heat exchanger 10 employs an outer shell or casing for housing the internal ceramic components which will be described later herein. Casing 12 includes a fume inlet 14 and outlet 16. Inlet 14 is adapted to be connected to a source of hot waste fumes or other source of high temperature fluid. Examples of various sources of heated fluids include aluminum melting furnaces, chemical waste incinerators, soaking pits, forge furnaces, dryers and other similar equipment that have chemical fumes or abrasive particles. Casing 12 further includes an inlet 18 and an outlet 20 for the fluid to be heated by the transferor fluid. The transferee and transferor fluid may vary depending upon the application but, for simplicity's sake, will be referred to as ambient air and fumes, respectively, in this specification.

The ambient air inlet 18 is preferably mounted on a door 22 or other similar structure to permit access to the internal component by releasing latch 24 and pivoting door 22 to its open position via hinges 26. Similarly, outlet 20 is mounted on another door 28. Casing 12 may also employ viewing windows 30, 32, and other conventional means for viewing or obtaining access to the internal components.

Figure 2:
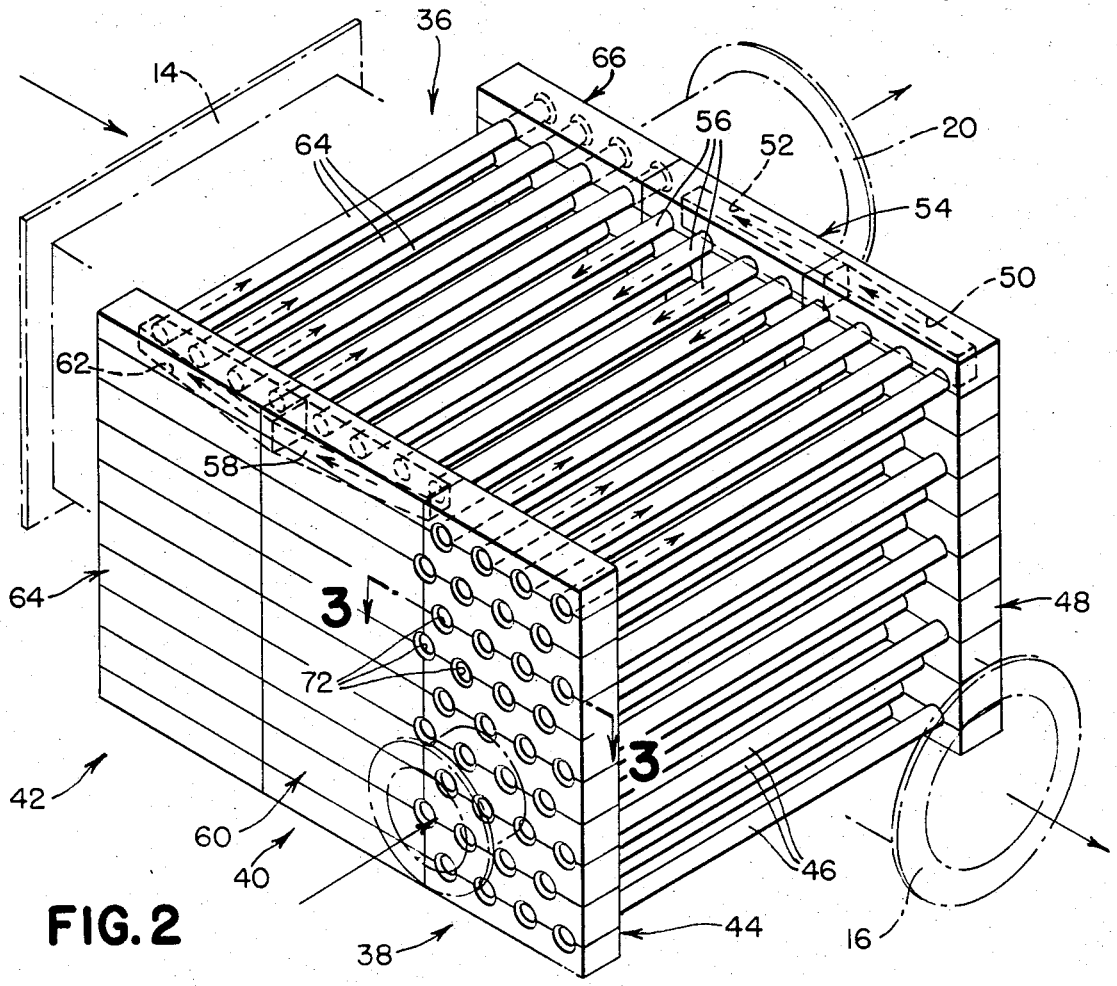
FIG. 2 is a perspective view of the internal heat exchanger system employing the teachings of this invention.

The internal components of the heat exchanger 10 are shown in FIG. 2. Shown therein is a multiple pass unit 36 having three zones 38, 40 and 42. As viewed in FIG. 2, zone 38 carries the ambient air from inlet 18 left to right from an inlet wall unit 44 through a plurality of tubes 46 to a central wall unit 48. As will be described in more detail later herein, wall unit 48 includes internally formed passageways 50 therein for bending the ambient air about a 90 degree angle and carrying it to cooperating passageways 52 in an adjacent central wall unit 54 in zone 40. Tubes 56 then carry the ambient air back across the chamber through which the fumes pass and into passageways 58 in wall unit 60. Passageways 58 cooperate with passageways 62 in wall unit 64 of zone 42 to move the air again across the heated chamber via tubes 64 to outlet wall unit 66. The heated ambient air then exits via outlet 20.

Each of the walls, or tube sheets as they are sometimes referred to in the trade, are formed of stacked sections. The number of sections depend upon the number of tubes to be supported thereby. Each of the sections are made of individual tiles which are cemented together with ceramic mortar. The tiles are made of high temperature resistant ceramic such as silicon carbide or other ceramic material having compatible thermal expansion and other characteristics with that of the tubes which may also be made of silicon carbide.

Figure 3:
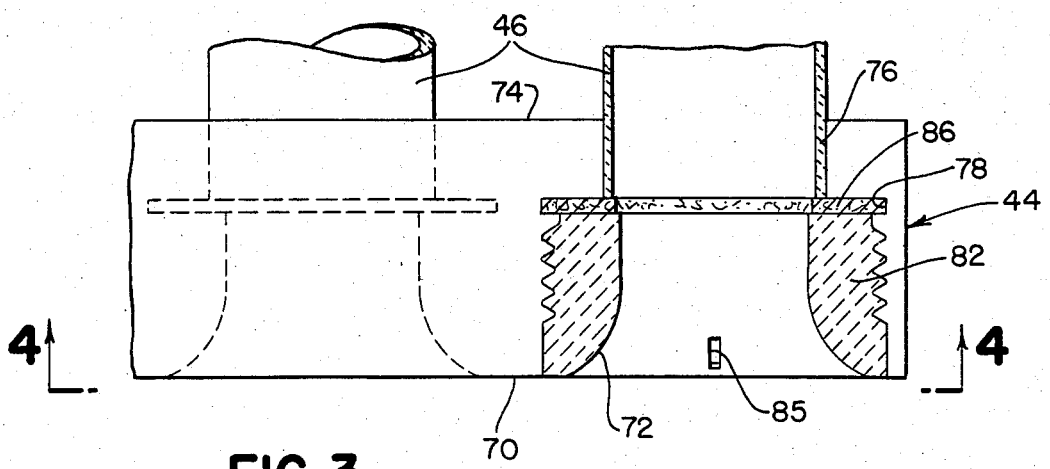
FIG. 3 is a cross sectional view of a portion of an inlet wall section taken along the lines 3—3 of FIG. 2.
Figure 4:
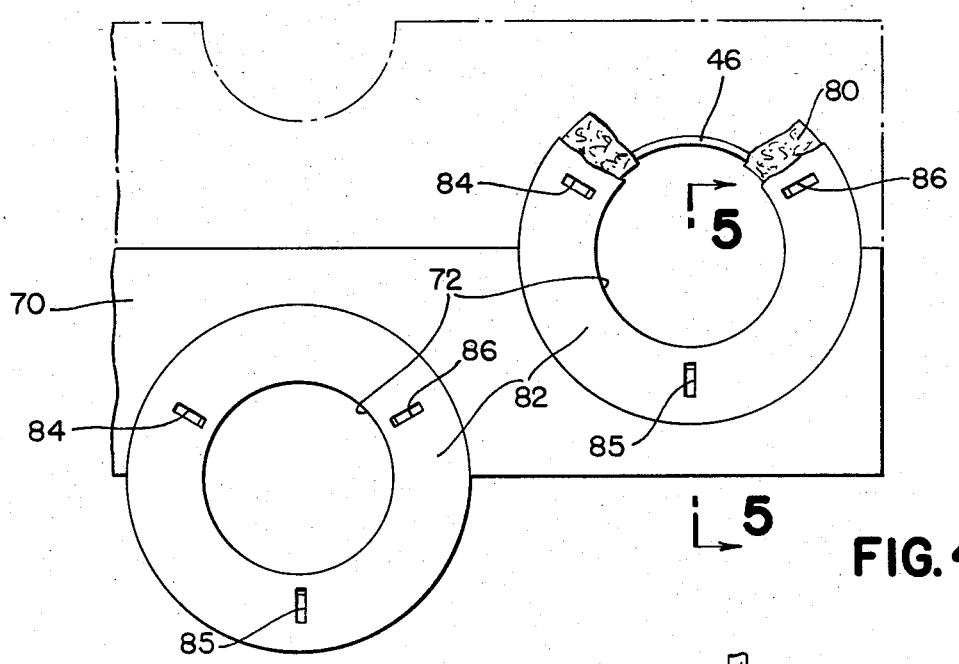
FIG. 4 is a front elevation view as viewed along lines 4—4 of FIG. 3.
Figure 5:
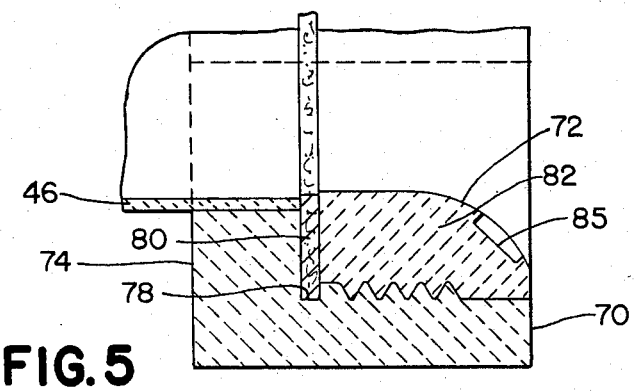
FIG. 5 is a partial cross sectional view along the lines 5—5 of FIG. 4.

The inlet wall 44 and outlet wall 66 are substantially identical and thus, a detailed description of one of them will suffice. Turn then to FIGS. 3–5 which shows the connection between the inlet wall 44 and its associated tubes 46. Pursuant to a feature of this invention the outer face 70 of wall 44 has a plurality of bell-shaped openings 72 formed therein. Each of the openings 72 taper inwardly about the longitudinal axis of its associated tube 46. The inner face 74 includes a bore 76 formed therein with a diameter larger than the inner diameter of opening 72. A circumferential groove 78 is formed in the inner surface of wall 44 concentric with and lying between bore 76 and opening 72. A resilient annular gasket 80 fits within groove 78. The inner diameter of gasket 80 is less than the inner diameter of opening 72. Preferably, gasket 80 is made of a high temperature woven fiber mesh such as that sold by Babcock and Wilcox under the trademark "Kaowool".

The ends of tubes 46 are mounted within bores 76 such that their ends engage gasket 80. As will appear, the opposite ends of tubes 46 are similarly connected at the opposing wall unit. When the temperature in the heat exchanger increases, the tubes expand and compress the gasket 80 and thus form a very good seal reducing leakage to a minimum. The openings 72 reduce the pressure drop of the air rushing from the space between the inner portion of ambient air inlet 18 and the straight sided ends of the tubes 46. By reducing the pressure drop and thereby the pressure differential between the ambient air and the fumes, leakage is further minimized. Additionally, the amount of horsepower for the fans driving the ambient air can be decreased for a given velocity thereby reducing energy related costs.

Purusant to a feature of this invention, the openings 72 may optionally be formed in threaded inserts 82 which are removably attached to wall 44. Front portions of inserts 82 may include suitable sockets 84–86 for receiving a tool for screwing and unscrewing the inserts into and out of the wall unit. The provision of inserts 82 enables the user to obtain easy access to tubes 46 for cleaning or replacement purposes. With additional reference to FIG. 1, the door 22 is opened and the inserts 82 are unscrewed and removed from their associated wall unit. The gasket 80 and tube 46 then may be grasped and pulled out of the wall unit. A new or cleaned tube may be inserted and the insert screwed back into the wall unit ready for use.

A study of the drawings will reveal that the tube attachment areas in the individual tiles are formed of staggered hemispheres formed in upper and lower surfaces thereof. When two adjacent tiles are cemented together their respective hemispheres form the completed tube openings. The insert 82, in this embodiment, bridges the adjacent tiles. However, a wide variety of alternative constructions should be apparent to one skilled in the art.

Figure 6:
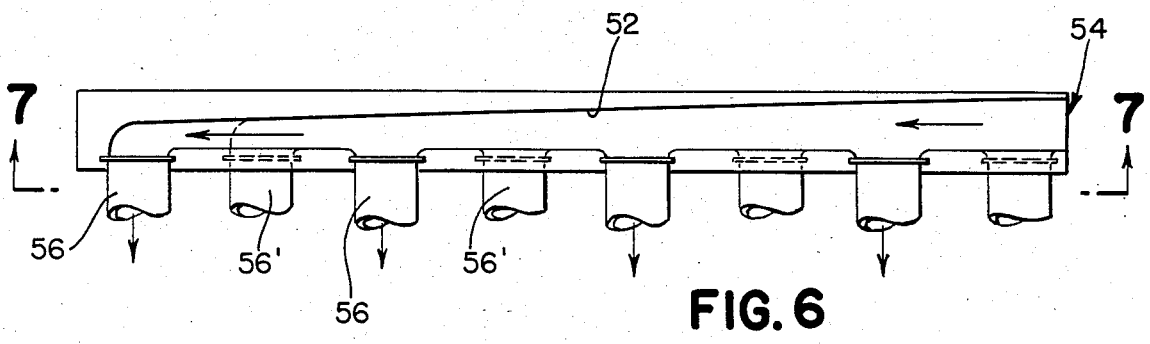
FIG. 6 is a top elevation view of a portion of a section used in one of the central wall units.
Figure 7:
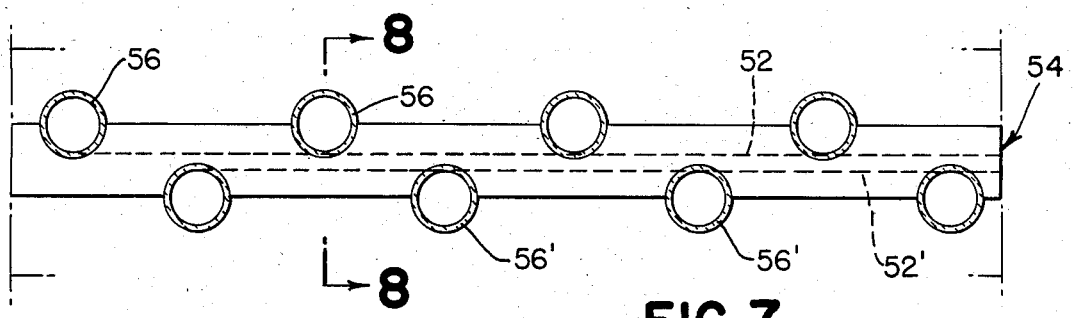
FIG. 7 is a rear elevation view as viewed along the lines 7—7 of FIG. 6.
Figure 8:
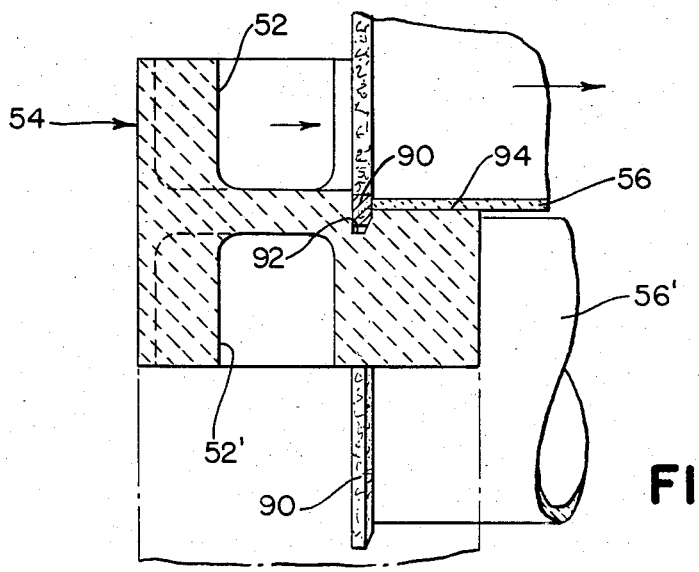
FIG. 8 is a partial cross sectional view taken along the lines 8—8 of FIG. 7.

A central wall unit and its tube attachment construction is shown in detail in FIGS. 6–8. These central wall units are termed as such because they are disposed between the inlet wall unit 44 and outer wall unit 66. The central wall units are generally identical except for the direction of the taper of its internal passageways and thus, a description of one of them will suffice. The wall section shown in FIGS. 6–8 would correspond to one of the middle sections of wall unit 54 of FIG. 2. As with the sections of the walls units 44 and 66, the sections of the central wall units are formed with staggered hemispheres which mate with corresponding hemispheres of adjacent sections to form the tube attachment areas therein. The wall-tube attachment is accomplished very much in the same manner as that previously described with the inlet wall unit 44. The ends of tubes 56 abut gaskets 90 formed in grooves 92 lying between axial bore 94 and internal passageway 52.

Pursuant to a feature of this invention, passageways 52 are formed wholly within the confines of their associated walls. The central wall units thus perform a dual purpose of supporting the ends of the tubes in a manner so as to minimize leakage and also to provide the return air ducts between the various zones of the heat exchanger. Preferably, the passageways in each section are tapered. With additional reference to FIG. 2, the passageways 50 in wall unit 48 diverge from an outermost tube in zone 38 to an area of enlarged cross sectional dimension located at the interface between passageway 50 of wall 48 and passageway 52 of wall 54. Passageway 52 then converges to the outermost tube in its zone. This configuration of the passageways serves to provide uniform air flow through each of the tubes.

Each horizontal layer of the tubes throughout the various zones may be envisioned as a wholly contained sealed subsystem. In other words, due to the separate passageways in the central wall units, the ambient air in the tubes of one layer does not mix with the ambient air in other layers. Consequently, if a leak does somehow develop in one layer it can be temporarily plugged, with the tubes in the other layers continuing to heat the ambient air until such time as the leak can be repaired. However, it should be understood that the wall unit can be constructed with one large internal passageway for all of the tube layers, if desired. In either case, the internal interzone passageway construction tends to minimize pressure drops and leakage within the system.

Those skilled in the art will come to appreciate the various advantages of the present invention after a study of the specification, drawings and claims. Among them include the construction of an all ceramic heat exchanger that is capable of withstanding high temperature and corrosive or abrasive environments. Since there are no moving or metal parts such as springs or wheels the heat exchanger is expected to exhibit long life because it is not subject to acid attack or other deteriorating conditions which have plagued heat exchangers using metal or metal parts. The heat exchanger can be used in a wide variety of applications and the number of tubes and types of wall units employed will depend upon the application. Additionally, the heat exchanger may be designed so that the hot fumes, instead of the ambient air, pass through the tubes. In such case the tubes would be heated by the fumes and the ambient air would flow around the tubes and be heated thereby. Still other modifications will become apparent to those skilled in the art and therefore, no limitation is intended by the specific example described above.

I claim:

1. An all ceramic heat exchanger assembly comprising:

(A) a ceramic wall defining an outer wall face and an inner wall face, (B) a constant diameter threaded bore formed in said outer wall face and extending part way through said wall;

(C) a constant diameter smooth walled bore of smaller diameter than said threaded bore formed in said inner wall face in coaxial relation to said threaded bore and extending part way through said wall to a location adjacent an inboard end of said threaded bore;

(D) an annular transverse shoulder extending between adjacent inboard ends of said threaded and smooth walled bores;

(E) an annular resilient gasket, having an outer diameter greater than the diameter of said smooth walled bore and an inner diameter less than the diameter of said smooth walled bore, positioned within said wall with one annular face thereof seated against said shoulder;

(F) an annular ceramic insert having an axial length substantially corresponding to the axial length of said threaded bore, a constant diameter threaded outer periphery, and a bell shaped inner periphery extending axially from end to end of the insert and tapering smoothly outwardly from an inboard diameter substantially corresponding to the inner diameter of said gasket to an outboard diameter substantially greater than its inboard diameter;

(G) said insert being threaded into said threaded bore to press an inboard annular end surface against the other annular face of said gasket and position an outboard annular end face substantially flush with said outer wall face; and (H) a ceramic tube, having an outer diameter less than the diameter of said smooth walled bore and an inner diameter substantially corresponding to the inner diameter of said gasket and the inboard diameter of said bell shaped opening, received in said smooth walled bore with an inboard end abutting said one face of said gasket concentrically within the sealing engagement of said one gasket face with said shoulder.

2. A heat exchanger assembly according to claim 1 wherein:

(I) an annular groove is provided at the juxtaposed inboard ends of said threaded and smooth walled bores;

(J) said groove has an outer diameter greater than the diameter of said threaded bore;

(K) one transverse wall of said groove is defined by the outer annular peripheral portion of said shoulder;

verse wall of said groove is defined by the outer annular peripheral portion of said shoulder;

(L) the other transverse wall of said groove is defined by an annular transverse shoulder extending radially outwardly from the inboard end of said threaded bore to the axial wall of said groove;

(M) the outer diameter of said gasket approximates the outer diameter of said groove; and (N) the outer peripheral portion of said gasket is received in said groove to position said gasket within said wall.

* * * * *

UNITED STATES PATENT AND TRADEMARK OFFICE

CERTIFICATE OF CORRECTION

PATENT NO. : 4,632,181

DATED : December 30, 1986

INVENTOR(S) : Graham

It is certified that error appears in the above-identified patent and that said Letters Patent is hereby corrected as shown below:

Column 6, lines 37-41,"one transverse wall of said groove is defined by the outer annular peripheral portion of said shoulder; verse wall of said groove is defined by the outer annular peripheral portion of said shoulder;" should be --one transverse wall of said groove is defined by the outer annular peripheral portion of said shoulder;--.

Signed and Sealed this

First Day of September, 1987

*Attest:*

*Attesting Officer*

DONALD J. QUIGG

*Commissioner of Patents and Trademarks*